US011320197B2

(12) United States Patent
Embry et al.

(10) Patent No.: US 11,320,197 B2
(45) Date of Patent: May 3, 2022

(54) ALTERNATIVE TWO COLUMN HRU DESIGN WITH RICH REFLUX

(71) Applicant: CONOCOPHILLIPS COMPANY, Houston, TX (US)

(72) Inventors: Dale L. Embry, Houston, TX (US); Paul R. Davies, Houston, TX (US); Qi Ma, Houston, TX (US); David W. Larkin, Houston, TX (US); Michael J. Calderon, Houston, TX (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 366 days.

(21) Appl. No.: 15/925,873

(22) Filed: Mar. 20, 2018

(65) Prior Publication Data

US 2018/0266757 A1 Sep. 20, 2018

Related U.S. Application Data

(60) Provisional application No. 62/473,701, filed on Mar. 20, 2017.

(51) Int. Cl.

| | |
|---|---|
| ***F25J 3/02*** | (2006.01) |
| ***C10L 3/10*** | (2006.01) |
| ***C10G 5/06*** | (2006.01) |
| ***C10G 5/04*** | (2006.01) |

(52) U.S. Cl.

CPC ..... *F25J 3/0214* (2013.01); *C10G 5/04* (2013.01); *C10G 5/06* (2013.01); *C10L 3/101* (2013.01);

(Continued)

(58) Field of Classification Search

CPC ..... F25J 3/0209; F25J 3/0233; F25J 3/0238; F25J 3/0242; F25J 2200/74;

(Continued)

(56) References Cited

U.S. PATENT DOCUMENTS

| | | | | |
|---|---|---|---|---|
| 2,775,103 | A | 12/1956 | Koble et al. | |
| 3,707,066 | A | 12/1972 | Carne et al. | |
| 4,421,535 | A | 12/1983 | Mehra | |
| 5,561,988 | A * | 10/1996 | Mehra | B01D 53/1487 62/625 |

(Continued)

FOREIGN PATENT DOCUMENTS

DE 102012020354 A1 4/2014

OTHER PUBLICATIONS

International Search Report, PCT/US2018/023285, dated Jun. 1, 2018; 2 pgs.

(Continued)

*Primary Examiner* — Brian M King
(74) *Attorney, Agent, or Firm* — Polsinelli PC

(57) ABSTRACT

The invention relates to a system, method and apparatus for removing heavies from natural gas. Natural gas and an external rich reflux gas feed are processed in a single column refluxed absorber. A bottoms stream is routed to a first heat exchanger and then to a stabilizer column where an overhead stream from the stabilizer column is routed through a condenser for partial separation into an overhead stream. A rich solvent may be introduced to the stabilizer column. The overhead stream is routed through a condenser for partial separation into a stabilizer reflux and a second overhead stream lights. The second overhead stream lights is routed to a heat exchanger and then routed to a partial condenser where the stream is separated into a heavies rich reflux stream, a distillate stream and heavies treated natural gas stream. The rich reflux is routed through a heat exchanger and the rich reflux is pumped to the single column refluxed absorber to be introduced into the single column refluxed absorber as the external rich reflux gas feed.

20 Claims, 3 Drawing Sheets

(52) U.S. Cl.
CPC ..... *F25J 3/0233* (2013.01); *F25J 3/0247* (2013.01); *C10L 2290/10* (2013.01); *C10L 2290/541* (2013.01); *F25J 2200/02* (2013.01); *F25J 2200/70* (2013.01); *F25J 2200/74* (2013.01); *F25J 2200/94* (2013.01); *F25J 2205/50* (2013.01); *F25J 2220/64* (2013.01); *F25J 2245/02* (2013.01)

(58) Field of Classification Search
CPC .. F25J 2200/78; F25J 2205/50; F25J 2215/62; F25J 2215/64; F25J 2215/66; F25J 2200/04
See application file for complete search history.

(56) References Cited

U.S. PATENT DOCUMENTS

| | | | | |
|---|---|---|---|---|
| 6,506,349 | B1 | 1/2003 | Khanmamedov | |
| 2002/0059865 | A1 | 5/2002 | Lemaire et al. | |
| 2007/0012072 | A1 | 1/2007 | Qualls et al. | |
| 2009/0301132 | A1 | 12/2009 | Evans et al. | |
| 2010/0000255 | A1* | 1/2010 | Mak ..... | B01D 53/14 62/625 |
| 2014/0260417 | A1 | 9/2014 | Herzog et al. | |
| 2016/0245587 | A1 | 8/2016 | Shah | |

OTHER PUBLICATIONS

The Extended European Search Report for Application No. 18772202.0 dated Nov. 13, 2020 (10 pages).

* cited by examiner

300

ALTERNATIVE TWO COLUMN HRU DESIGN WITH RICH REFLUX

CROSS-REFERENCE TO RELATED APPLICATIONS

This application is a non-provisional application which claims benefit under 35 USC § 119(e) to U.S. Provisional Application Ser. No. 62/473,701 filed Mar. 20, 2017, entitled "ALTERNATIVE TWO COLUMN HRU DESIGN WITH RICH REFLUX," which is incorporated herein in its entirety.

STATEMENT REGARDING FEDERALLY SPONSORED RESEARCH OR DEVELOPMENT

None.

FIELD OF THE INVENTION

The present invention relates generally to a method and apparatus for processing natural gas. In another aspect, methods and apparatus are provided for removing heavies from natural gas using a light oil reflux in a heavies removal unit.

BACKGROUND OF THE INVENTION

In the processing of natural gas there are several challenges with the existing heavies removal processes. First, to separate C6+ species from the natural gas feed the reboiled absorber (i.e. the heavies removal column) requires a dual column design which increases its capital and operating costs. In addition, the absorber's two column geometry is quite sensitive to both feed composition and conditions when sizing it. As a result, the compositional feed range a specific design can run may be quite limiting. Finally, in some cases when the absorber's diameters are too significantly different (i.e. due to feed composition) a superstructure is required. This results in an additional increase in processing costs.

BRIEF SUMMARY OF THE DISCLOSURE

The invention more particularly relates to a system, method and apparatus for removing heavies from natural gas. Natural gas and an external rich reflux gas feed are processed in a single column refluxed absorber. A bottoms stream is routed to a first heat exchanger and then to a stabilizer column where an overhead stream from the stabilizer column is routed through a condenser for partial separation into an overhead stream. A rich solvent may be introduced to the stabilizer column. The overhead stream is routed through a condenser for partial separation into a stabilizer reflux and a second overhead stream lights. The second overhead stream lights is routed to a heat exchanger and then routed to a partial condenser where the stream is separated into a heavies rich reflux stream, a distillate stream and heavies treated natural gas stream. The rich reflux is routed through a heat exchanger and the rich reflux is pumped to the single column refluxed absorber to be introduced into the single column refluxed absorber as the external rich reflux gas feed.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

The following examples of certain embodiments of the invention are given. Each example is provided by way of explanation of the invention, one of many embodiments of the invention, and the following examples should not be read to limit, or define, the scope of the invention.

To address issues with heavies removal, an alternative two column heavies removal unit (HRU) design with rich reflux with a refluxed absorber and stabilizer can be used. As compared to a reboiled absorber HRU design with rich reflux, methods and apparatus provided with this disclosure provide for a refluxed absorber with a shorter single column diameter unit with a condenser, but no reboiler. This results in reducing the system's overall capital and operating expenditures. It also increases its operational feed flexibility as a result of column dimensions that are not as sensitive to feed composition. Further, the absorber's condenser helps reduce the system's C6+ loss and external solvent loss to the overheads as well as increases its C6+ separation efficiency.

The Liquefied Natural Gas (LNG) Optimized Cascade Process uses a heavies removal distillation column to eliminate C6+ hydrocarbons (i.e. heavy components) from the natural gas prior to condensing the gas to LNG. In the usual case gas has already been amine treated and dehydrated prior to heavies removal. Heavies removal is done in order to prevent freezing from occurring in the liquefaction heat exchangers and to moderate the heating value of the LNG.

Figure 1:
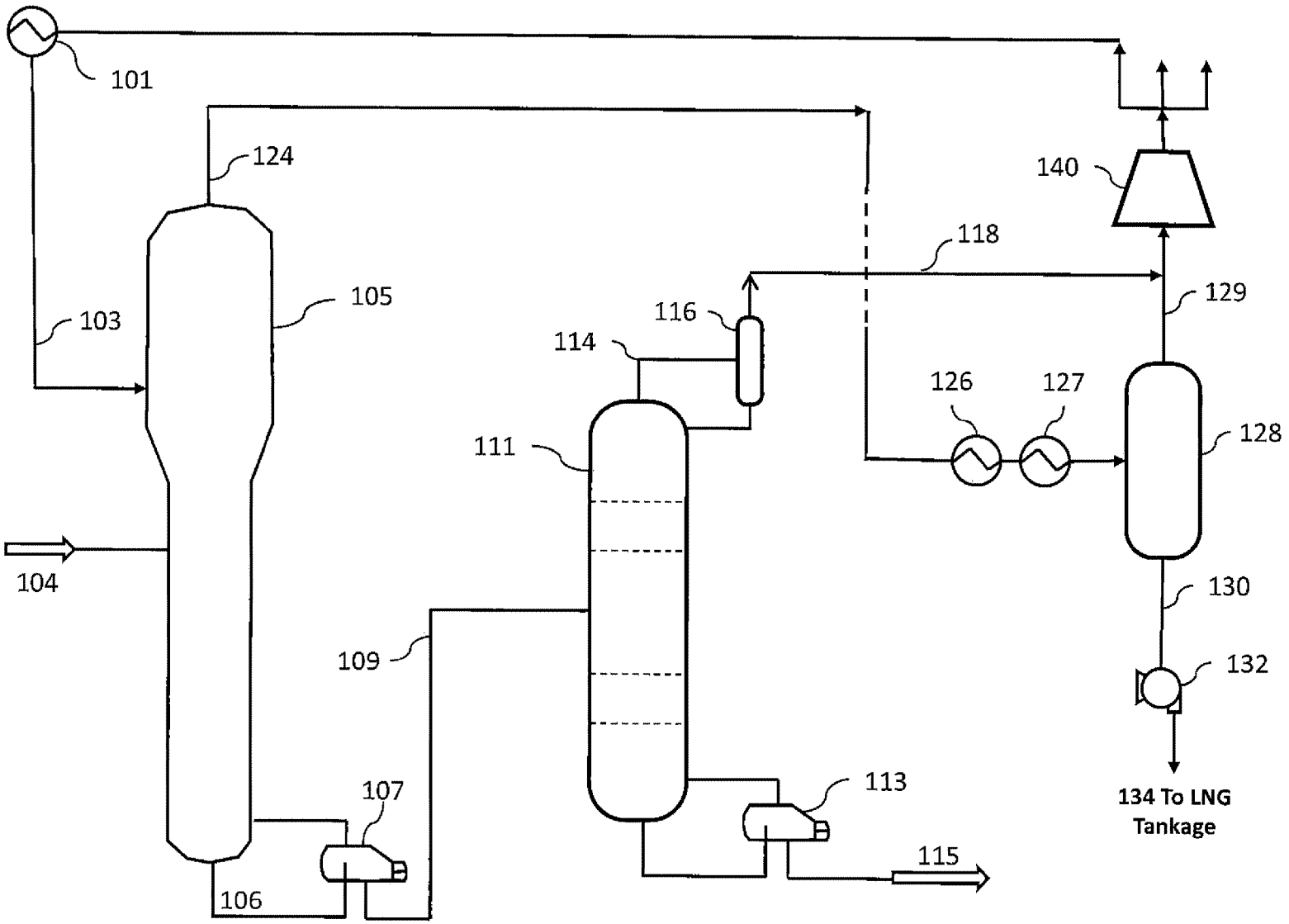
FIG. 1 illustrates a simplified diagram of a heavies removal process using an external lean reflux.

As illustrated in FIG. 1, the existing heavies removal process includes feeding chilled external lean reflux natural gas 103, which has been piped through heat exchanger 101 to the top of the dual column reboiled absorber 105 where most of the C6+ components are removed. The dual column reboiled absorber 105 also receives a natural gas feed 104. The heavies liquid bottom stream 106, passes through reboiler 107, is then sent 109 to a stabilizer column 111 where it is stabilized as the heaviest components are removed as condensate 115. The lighter components are separated with condenser 116 into a methane rich recycle stream and external lean reflux stream 118 sent to compressors 140 and sent to heat exchanger 101 for delivery as external lean reflux 103 to the heavies removal column 105. The heavies treated natural gas 124 feed exits the top of the heavies removal column 105. This overhead stream 124 can now be further cooled by one or more heat exchangers 126 and optional heat exchanger 127, pass into flash drum 128 and be separated as overhead 129 to deliver lean reflux to compressors 140, or exit bottom outlet as distillate 130 and be pumped 132 to LNG storage/tankage 134.

One of the main issues with the current heavies removal system is that the lean reflux rate to the heavies removal column has to be considerably increased as the natural gas feed becomes leaner in C2 through C5 components, but not in C6+ components. The increase in rate allows the system to still be able to remove the heavy components from the lean feed, but also increases its compression costs (i.e. capex and opex due to gas compression requirements).

Figure 2:
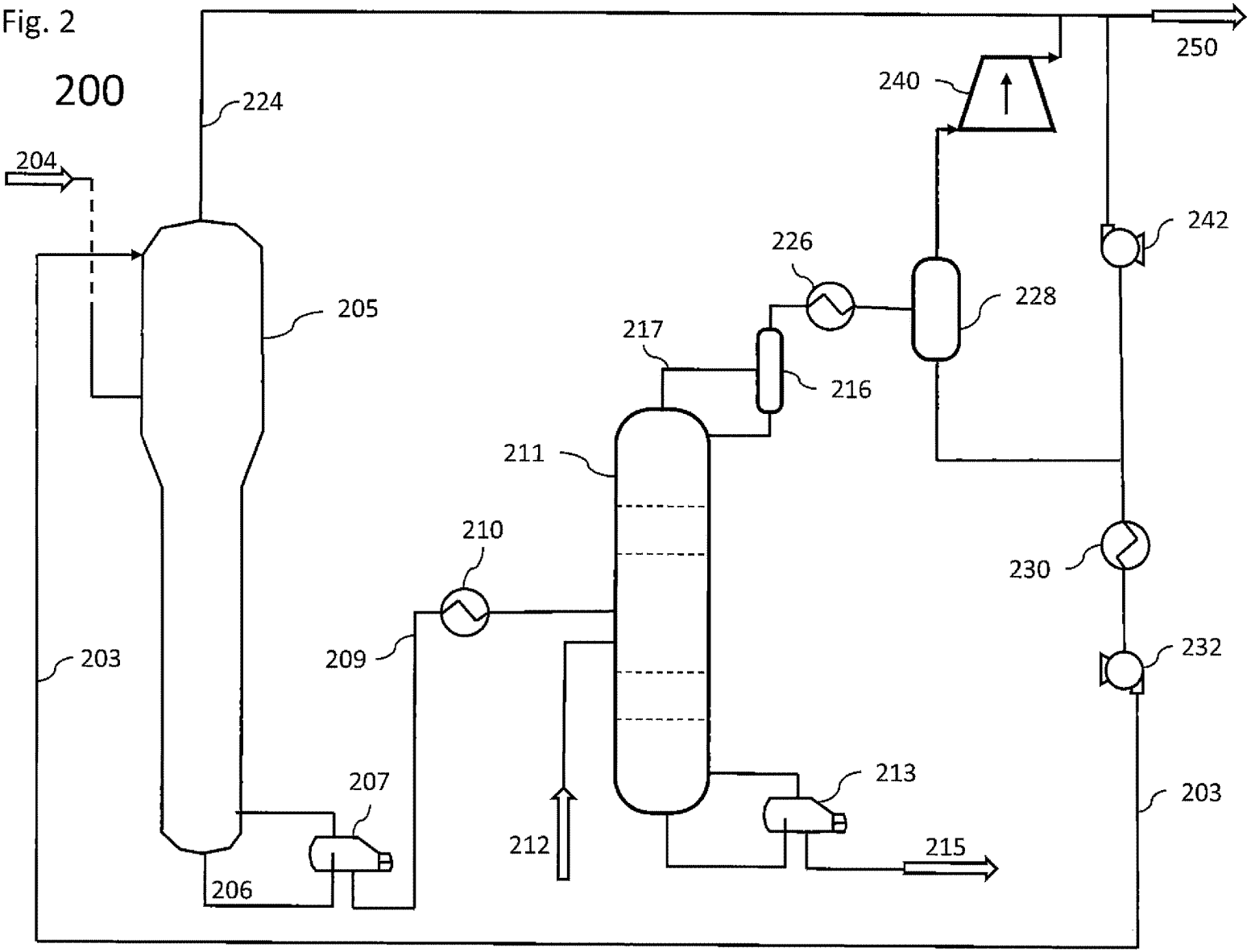
FIG. 2 illustrates a conventional two-column heavies removal unit design using an external rich reflux.

An alternative HRU design as illustrated in FIG. 2, Conventional Two Column HRU Design with Rich Reflux 200, replaces the lean reflux stream (LNG) 103 with a rich one 203 comprised of C2s through C5s. As illustrated in FIG. 2, the rich reflux stream 203 is fed to the column 205 (i.e. a reboiled absorber) to remove C6+ components within the natural gas feed 204. After the bottom liquid stream 206 passes through reboiler 207, the resulting liquid bottom product stream 209 passes through heat exchanger 210 and is then fed to the stabilizer 211 to produce condensate 215 from reboiler 213 for sale. The overhead 217 in the stabilizer 211 is partially condensed as overhead with condenser 216, then routed through heat exchanger 226 and into partial condenser 228 in order to produce 1) heavies treated natural gas to send through compressor 240 to heavies treated natural gas 250, and 2) distillates that may be pumped 242 to storage with heavies treated natural gas 250 and 3) the rich reflux 203, routed through heat exchanger 230 and pumped 232 as external rich reflux 203 to the heavies removal column 205.

Since the reflux 203 is a liquid, the alternative design does not need gas compression, but instead uses a pump 232 to set the reflux flowrate (i.e. lower capex and opex requirements). In addition, the rich reflux flowrate requirement is lower than the lean one as a result of the higher separation efficiency of heavy components within the HRU 205. In cases where the HRU wetting rate from the rich reflux is too low (i.e. natural gas feed is too lean), the design utilizes an external rich solvent 212 to maintain an adequate rate. This rich solvent 212 (also referred as purchased solvent) can be input into the process via the stabilizer 211 or the recycle. The external solvent 212 is preferentially composed of hydrocarbons ranging from ethane to pentane. Mixtures that are predominately composed of isopentane and/or normal pentane are preferred due to lower usage and improved performance in removal of the heavies.

Although the conventional two column HRU rich reflux design 200 addresses the issue with lean feeds, there are several additional challenges with a heavies removal system that neither it nor the lean reflux design 100 addresses. First, to separate C6+ species from the natural gas feed the reboiled absorber 205 (i.e. the heavies removal column) requires a dual column design which increases its capex. In addition, the absorber's two column geometry is quite sensitive to both feed composition and conditions when sizing it. As a result, the compositional feed range a specific design can run is quite limiting. Finally, in some cases when the absorber's diameters are too significantly different (i.e. due to feed composition) a superstructure is required. This results in an additional increase in process capex.

Figure 3:
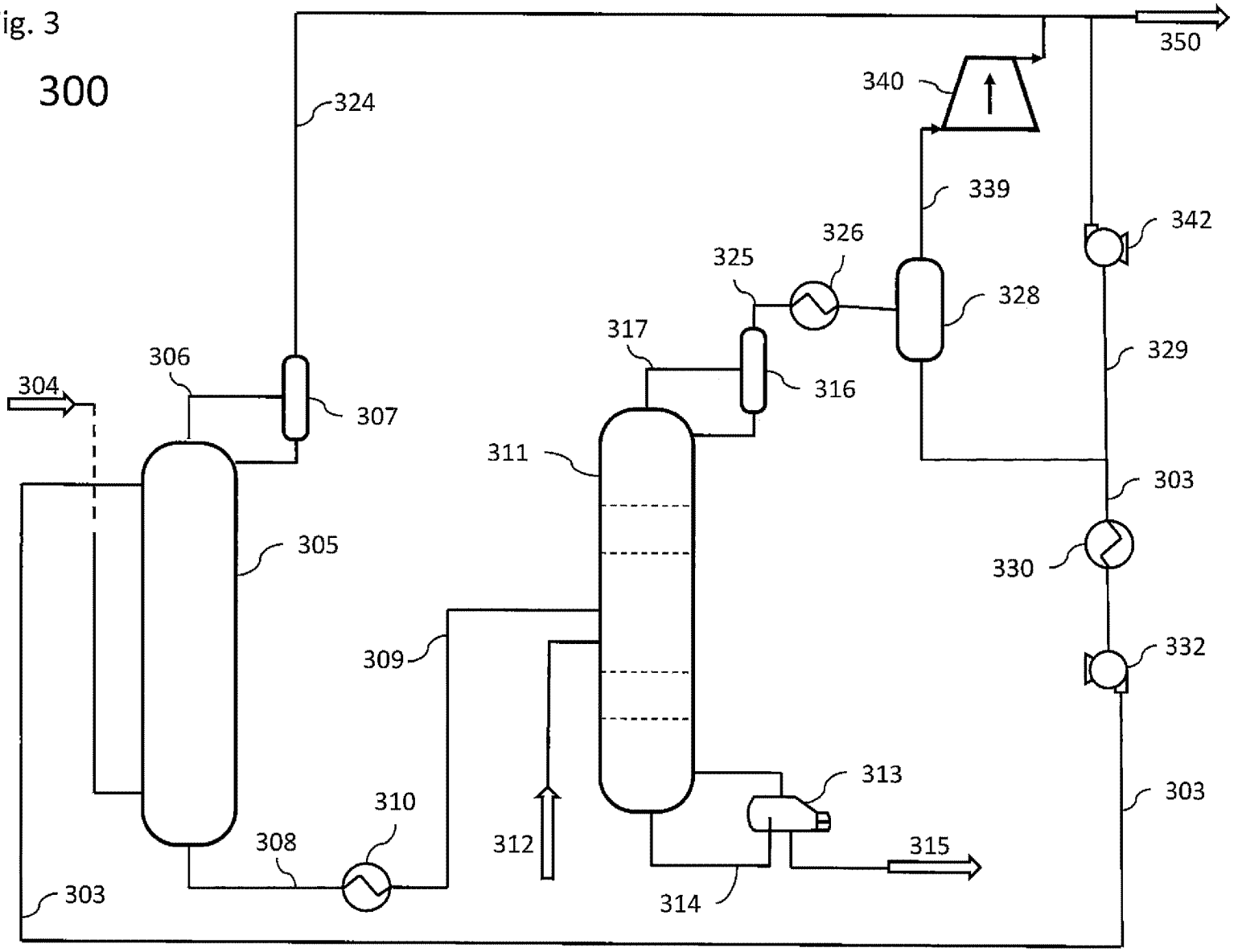
FIG. 3 illustrates an alternative two-column heavies removal unit design using an external rich reflux.

To address these issues, as illustrated in FIG. 3 with the Alternative Two Column HRU Design with Rich Reflux 300, the methods, apparatus and systems provided herein replaces the dual column reboiled absorber 205 in the conventional two column HRU design with rich reflux 200, with a single column refluxed absorber 305. As illustrated in FIG. 3, the single column refluxed absorber 305 may be a shorter single column diameter unit with a condenser 307, with no reboiler. This results in reducing the system's overall capital expenditures and operating expenditures. The methods, apparatus and systems provided also increases the operational feed flexibility as a result of column dimensions that are not as sensitive to feed composition, making the system and method especially favorable for use with highly variable feedstocks. Further, the absorber's condenser 307 helps reduce the units C6+ loss and external solvent 312 loss to the overheads as well as increase its C6+ separation efficiency. Finally, the stabilizer 311 provided with this system functions as the bottom half of the previous 105 and 205, as well as 111 and 211.

As illustrated in FIG. 3, the rich reflux stream 303 is fed to the single column refluxed absorber 305 to remove C6+ components within the natural gas feed 304. After the bottom liquid stream 309 passes through heat exchanger 310 it is then fed to the stabilizer 311 to produce condensate 315 from reboiler 313 for sale. The overhead 317 from the stabilizer 311 is partially condensed with condenser 316, then routed to heat exchanger 326 and into partial condenser 328 in order to produce 1) heavies treated natural gas to send to compressor 340 and on to heavies natural gas storage 350, and 2) distillates that may be pumped 342 to storage with heavies treated natural gas storage 350, and 3) the rich reflux 303 routed through heat exchanger 330 and pumped 332 as external rich reflux 303 to the heavies removal column 305.

Since the reflux 303 is a liquid, the alternative design does not need gas compression, but instead uses a pump 332 to set the reflux flowrate (i.e. lower capex and opex requirements). In addition, the rich reflux flowrate requirement is lower than the lean flowrate requirement as a result of the higher separation efficiency of heavy components. In cases where the HRU wetting rate from the rich reflux is too low (i.e. natural gas feed is too lean), the design utilizes an external rich solvent 312 to maintain an adequate rate. This rich solvent 312 (also referred as purchased solvent) can be input into the process via the stabilizer 311 or the recycle. The external solvent 312 is preferentially composed of hydrocarbons ranging from ethane to pentane. Mixtures that are predominately composed of isopentane and/or normal pentane are preferred due to lower usage and improved performance in removal of the heavies.

A nonlimiting method provided herein comprises introducing a natural gas feed 304 to a single column refluxed absorber 305, introducing an external rich reflux gas feed 303 to the single column refluxed absorber 305, processing the natural gas feed 304 and the external rich reflux gas feed 303 in the single column refluxed absorber 305 to produce a first bottoms stream 308 and a first overhead stream 306, wherein the first bottoms stream 308 and the first overhead stream 306 are separate streams upon expulsion from the single column refluxed absorber 305, wherein the first bottoms stream 308 is routed to a first heat exchanger 310 and then to a stabilizer column 311 and the first overhead stream 306 is routed through a condenser 307 for partial separation of the first overhead stream into heavies-treated natural gas 324. The heavies treated natural gas may then be routed to storage of heavies treated natural gas. A rich solvent (C2 to C5) 312 may be introduced to the stabilizer column 311. The first bottoms stream 308 and the rich solvent 312 is processed in the stabilizer column 311 to produce a second bottoms stream 314 and a second overhead stream 317, wherein the second bottoms stream 314 and the second overhead stream 317 are separate streams upon expulsion from the stabilizer column 311, wherein the second bottoms stream 314 is routed to a reboiler 313 and then the reboiler bottom stream product is expelled as stabilized condensate 315, which may be stored, and the second overhead stream 317 is routed through a condenser 316 for partial separation of the second overhead stream 317 into a stabilizer reflux and a second overhead stream lights 325. The second overhead stream lights 325 is routed to a heat exchanger 326 and then routed to the to a partial condenser 328. In the partial condenser 328, the second overhead stream lights 325 is separated into a heavies rich reflux stream 303, a distillate stream 329 and heavies treated natural gas stream 339. The rich reflux 303 is routed through a heat exchanger 330 and the rich reflux 303 is pumped 332 to the single column refluxed absorber 305 to be introduced into the single column refluxed absorber 305 as the external rich reflux gas feed 303.

In other aspects, the heavies treated natural gas is routed from partial condenser to a compressor for storage of heavies treated natural gas. The distillate stream may be routed from the partial condenser through a pump for storage with heavies treated natural gas. The external rich reflux feed inlet may be positioned on the single column refluxed absorber at a higher elevation than the natural gas feed inlet. In still another aspect, the rich solvent comprises ethane, propane, butane and pentane. In addition, the rich solvent may predominantly be composed of isopentane, normal pentane, or both.

In another nonlimiting embodiment, an apparatus for processing natural gas is provided, the apparatus comprises a single column refluxed absorber 305 with a first condenser 307 and a natural gas feed 304 inlet at a lower elevation than an external rich reflux gas feed 303 inlet, a first heat exchanger 310 downstream from the bottoms outlet of the single column refluxed absorber 305, a stabilizer column 311 downstream from the first heat exchanger 310, the stabilizer column 311 comprising a second condenser 316 and a reboiler 313, wherein the stabilizer column 311 has an inlet for a rich solvent 312 feed and wherein the second condenser 316 partially separates a natural gas overhead 317 into overhead stream lights 325 and a second heat exchanger 326 downstream of the second condenser 316. A partial condenser 328 is downstream from the second heat exchanger 326 and is configured to separate, from the overhead stream lights 325, heavies treated natural gas 339 expelled though the overhead outlet, distillates 329 and rich reflux 303 expelled from the bottoms outlet. A third heat exchanger 330 is downstream from the bottoms outlet of the partial condenser and a first pump 332 is downstream from the third heat exchanger 330 to pump the rich reflux 303, as an external rich reflux, to the single column refluxed absorber 305. The distillate stream 329 may be pumped 342 to heavies treated natural gas.

In another aspect the apparatus further comprises a heavies treated natural gas storage downstream from the first condenser, a compressor downstream from an overhead outlet for compressing overhead vapor from the partial condenser, a stabilized condensate storage downstream from the reboiler of the stabilizer and a second pump downstream from the bottoms outlet of the partial condenser, to pump distillates to a heavies treated natural gas storage.

In still another nonlimiting embodiment, a system for processing natural gas comprises a single column refluxed absorber 305 with a first condenser 307 and a natural gas feed 304 inlet at a lower elevation than an external rich reflux gas feed 303 inlet, a first heat exchanger 310 downstream of a bottoms outlet of the single column refluxed absorber 305, a stabilizer column 311 downstream from the first heat exchanger 310, the stabilizer column 305 comprising a second condenser 316 and a reboiler 313, wherein the stabilizer column has an inlet for a rich solvent feed 312 and wherein the second condenser 316 partially separates a natural gas overhead 317 into overhead stream lights 325. A second heat exchanger 326 is downstream of the second condenser 316. A partial condenser 328 is downstream from the second heat exchanger 326 and is configured to separate, from the overhead stream lights, heavies treated natural gas 339 that is expelled though the overhead outlet, distillates 329 and rich reflux 303 expelled through a bottoms outlet, and a third heat exchanger 330 is downstream from the bottoms outlet of the partial condenser 328 to cool the rich reflux 303. A first pump 332 is downstream from the third heat exchanger 330 to pump the rich reflux 303, as an external rich reflux, to the single column refluxed absorber 305. Additionally, there may be a compressor 340 downstream from the partial condenser 328 overhead outlet, in order to compress the heavies treated natural gas, and a second pump 342 may be downstream from the bottoms outlet of the partial condenser to pump distillates 329 to a heavies treated natural gas storage.

In closing, it should be noted that the discussion of any reference is not an admission that it is prior art to the present invention, especially any reference that may have a publication date after the priority date of this application. At the same time, each and every claim below is hereby incorporated into this detailed description or specification as a additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A method for natural gas processing, the method comprising:

introducing a natural gas feed to a single column refluxed absorber;

introducing an external rich reflux gas feed to the single column refluxed absorber;

processing the natural gas feed and the external rich reflux gas feed in the single column refluxed absorber to produce a first bottoms stream and a first overhead stream, wherein the first bottoms stream and the first overhead stream are separate streams upon expulsion from the single column refluxed absorber;

outputting the first bottoms stream from the single column refluxed absorber to a first heat exchanger;

outputting the first bottoms stream from the first heat exchanger to a stabilizer column;

outputting the first overhead stream from the single column refluxed absorber through a first condenser for partial separation of the first overhead stream into heavies-treated natural gas;

introducing a rich solvent to the stabilizer column;

processing the first bottoms stream and the rich solvent in the stabilizer column to produce a second bottoms stream and a second overhead stream, wherein the second bottoms stream and the second overhead stream are separate streams upon expulsion from the stabilizer column;

routing the second overhead stream through a second condenser for partial separation of the second overhead stream into overhead stream lights;

routing the overhead stream lights to a second heat exchanger and then to a partial condenser;

separating, in the partial condenser, the overhead stream lights into a heavies rich reflux stream, a distillate stream and a heavies treated natural gas stream;

routing the heavies rich reflux stream through a third heat exchanger; and pumping the heavies rich reflux stream to the single column refluxed absorber to be introduced into the single column refluxed absorber as the external rich reflux gas feed.

2. The method of claim 1, further comprising:

routing the heavies treated natural gas stream from the partial condenser to a compressor for storage.

3. The method of claim 1, further comprising:

routing the distillate stream from the partial condenser through a pump for storage.

4. The method of claim 1, wherein a first inlet of the external rich reflux gas feed is positioned on the single column refluxed absorber at a higher elevation than a second inlet for the natural gas feed.

5. The method of claim 1, wherein the rich solvent comprises one or more of ethane, propane, butane and pentane.

6. The method of claim 1, wherein the rich solvent comprises a predominant composition of one selected from the group consisting of: i) isopentane, ii) normal pentane, and iii) isopentane and normal pentane.

7. An apparatus for processing natural gas, the apparatus comprising:

a single column refluxed absorber comprising a natural gas feed inlet at a lower elevation than an external rich reflux gas feed inlet, the single column refluxed absorber configured to expulse a bottoms stream;

a first heat exchanger downstream from the single column refluxed absorber, such that the bottoms stream is output from the single column refluxed absorber into the first heat exchanger;

a stabilizer column downstream from the first heat exchanger, such that the bottoms stream is output from the first heat exchanger into the stabilizer column, wherein the stabilizer has an inlet for receiving a rich solvent, the stabilizer column configured to produce a natural gas overhead by processing the bottoms stream and the rich solvent;

a condenser configured to partially a separate the natural gas overhead into overhead stream lights;

a partial condenser having an overhead outlet and a bottoms outlet, the partial condenser configured to separate, from the overhead stream lights, heavies treated natural gas expelled though the overhead outlet and distillates and a rich reflux expelled from the bottoms outlet;

a first pump configured to pump the rich reflux, as an external rich reflux, to the single column refluxed absorber.

8. The apparatus of claim 7, further comprising:

a heavies treated natural gas storage downstream from a condenser of the single column refluxed absorber.

9. The apparatus of claim 7, further comprising:

a compressor downstream from the overhead outlet, the compressor configured to compress overhead vapor from the partial condenser.

10. The apparatus of claim 7, further comprising:

a stabilized condensate storage downstream from a reboiler of the stabilizer.

11. The apparatus of claim 7, further comprising:

a second pump downstream from the bottoms outlet of the partial condenser, the second pump configured to pump the distillates to a heavies treated natural gas storage.

12. A system for processing natural gas, the system comprising:

a single column refluxed absorber comprising a first condenser and a natural gas feed inlet at a lower elevation than an external rich reflux gas feed inlet, the single column refluxed absorber configured to expulse a bottoms stream through a bottoms outlet;

a first heat exchanger downstream of the bottoms outlet of the single column refluxed absorber, such that the first heat exchanger receives the bottoms stream from the bottoms outlet of the single column refluxed absorber;

a stabilizer column downstream from the first heat exchanger, such that the bottoms stream is output from the first heat exchanger into the stabilizer column, wherein the stabilizer has an inlet for a rich solvent, the stabilizer column configured to produce an overhead stream by processing the bottoms stream and the rich solvent;

a second condenser of the stabilizer column, the second condenser partially separating the overheard stream into overhead stream lights;

a second heat exchanger downstream of the second condenser;

a partial condenser downstream from the second heat exchanger, the partial condenser configured to separate, from the overhead stream lights, heavies treated natural gas, distillates and a rich reflux;

a third heat exchanger downstream from the partial condenser;

a first pump downstream from the third heat exchanger, the first pump configured to pump the rich reflux, as an external rich reflux, to the external rich reflux gas feed inlet of the single column refluxed absorber.

13. An apparatus for processing natural gas, the apparatus comprising:

a single column refluxed absorber comprising a first condenser and a natural gas feed inlet at a lower elevation than an external rich reflux gas feed inlet, the single column refluxed absorber configured to expulse a bottoms stream via a bottoms outlet, the bottoms stream produced by processing natural gas received via the natural gas feed inlet and an external rich reflux received via the external rich reflux gas feed inlet;

a first heat exchanger downstream from the bottoms outlet of the single column refluxed absorber, such that the bottoms stream is received by the first heat exchanger from the bottoms outlet of the single column refluxed absorber;

a stabilizer column downstream from the first heat exchanger, the stabilizer column comprising a second condenser and a reboiler, the stabilizer column configured to receive the bottoms stream from the first heat exchanger;

a rich solvent feed inlet of the stabilizer column, the rich solvent feed inlet configured to receive a rich solvent, the stabilizer column configured to produce a natural gas overhead by processing the bottoms stream and the rich solvent, and the second condenser configured to partially separate the natural gas overhead into overhead stream lights;

a second heat exchanger downstream of the second condenser;

a partial condenser downstream from the second heat exchanger, the partial condenser having an overhead outlet and a bottoms outlet and being configured to separate, from the overhead stream lights, heavies treated natural gas expelled though the overhead outlet of the partial condenser, distillates and a rich reflux through the bottoms outlet of the partial condenser;

a third heat exchanger downstream from the bottoms outlet of the partial condenser, the third heat exchanger configured to cool the rich reflux from the partial condenser;

a first pump downstream from the third heat exchanger, the first pump configured to pump the rich reflux, as the external rich reflux, to the single column refluxed absorber;

a compressor, downstream from the partial condenser overhead outlet, the compressor configured to compress the heavies treated natural gas; and a second pump downstream from the bottoms outlet of the partial condenser, the second pump configured to pump distillates to a heavies treated natural gas storage.

14. The method of claim 1, further comprising:

routing the heavies treated natural gas of the first overhead stream to storage.

15. The method of claim 1, further comprising:

routing the second bottoms stream to a reboiler, wherein a reboiler bottom stream is expelled from the reboiler as stabilized condensate.

16. The apparatus of claim 7, further comprising:

a second heat exchanger downstream of the condenser, the partial condenser being downstream from the second heat exchanger.

17. The apparatus of claim 7, further comprising:

a third heat exchanger downstream from the bottoms outlet of the partial condenser, the first pump being downstream from the third heat exchanger.

18. The system of claim 12, wherein the stabilizer column further includes a reboiler.

19. The system of claim 12, wherein the partial condenser includes a bottoms outlet, the rich reflux being expulsed through the bottoms outlet, the third heat exchanger being downstream from the bottoms outlet of the partial condenser.

20. The system of claim 12, further comprising:

a compressor, downstream from an overhead outlet of the partial condenser, the compressor configured to compress the heavies treated natural gas; and a second pump downstream from a bottoms outlet of the partial condenser, the second pump configured to pump the distillates to a heavies treated natural gas storage.

* * * * *